US006846253B1

(12) United States Patent
Szwalek

(10) Patent No.: US 6,846,253 B1
(45) Date of Patent: Jan. 25, 2005

(54) SOCCER TRAINING SYSTEM

(75) Inventor: Damian A. Szwalek, Pittsburgh, PA (US)

(73) Assignee: Dick's Sporting Goods, Inc., Pittsburgh, PA (US)

( * ) Notice: Subject to any disclaimer, the term of this patent is extended or adjusted under 35 U.S.C. 154(b) by 0 days.

(21) Appl. No.: 10/386,631

(22) Filed: Mar. 12, 2003

(51) Int. Cl.[7] ..... A63B 69/00

(52) U.S. Cl. ..... 473/446; 473/422; 473/434; 473/449; 473/478

(58) Field of Search ..... D21/699, 705; 473/422, 431, 423–430, 446, 471, 478; 273/402–408, 410

(56) References Cited

U.S. PATENT DOCUMENTS

| | | | | | |
|---|---|---|---|---|---|
| 3,704,849 | A | * | 12/1972 | Green | 248/165 |
| 4,014,521 | A | * | 3/1977 | Berman | 256/1 |
| 4,083,561 | A | * | 4/1978 | Daffer, Jr. | 473/432 |
| 4,702,478 | A | * | 10/1987 | Kruse | 273/127 B |
| D303,824 | S | * | 10/1989 | Maloney, II | D21/699 |
| 4,921,257 | A | * | 5/1990 | Heller | 473/446 |
| 4,948,147 | A | * | 8/1990 | Pallanca | 273/402 |
| 4,948,149 | A | * | 8/1990 | Lin et al. | 473/492 |
| 5,000,461 | A | * | 3/1991 | Borazjani | 273/400 |
| 5,048,844 | A | * | 9/1991 | Haseltine | 273/400 |
| 5,080,375 | A | * | 1/1992 | Moosavi | 473/478 |
| 5,181,725 | A | * | 1/1993 | Leras et al. | 473/446 |
| 5,273,292 | A | * | 12/1993 | Pardi et al. | 273/400 |
| 5,367,503 | A | * | 11/1994 | Lowrance | 368/10 |
| D356,841 | S | * | 3/1995 | Temple | D21/705 |
| 5,431,411 | A | | 7/1995 | Padilla | |
| D361,353 | S | * | 8/1995 | Smith | D21/699 |
| 5,476,266 | A | * | 12/1995 | Caruso | 473/478 |
| D368,290 | S | * | 3/1996 | Lobos et al. | D21/705 |
| 5,503,402 | A | * | 4/1996 | Moss, Jr. | 273/400 |
| 5,513,843 | A | * | 5/1996 | Russell | 473/416 |
| 5,527,032 | A | * | 6/1996 | Coleman et al. | 473/439 |
| 5,539,957 | A | | 7/1996 | Schmidt | |
| 5,549,304 | A | * | 8/1996 | Davis | 273/396 |
| 5,556,104 | A | | 9/1996 | Guillen, Jr. | |
| 5,564,711 | A | * | 10/1996 | Scheie | 273/400 |
| 5,580,064 | A | * | 12/1996 | Childers, Jr. | 273/400 |
| 5,586,768 | A | * | 12/1996 | Pavonetti | 473/478 |
| 5,615,889 | A | * | 4/1997 | Long | 273/396 |
| 5,746,533 | A | | 5/1998 | Schmidt | |
| 5,746,669 | A | * | 5/1998 | Sinsheimer et al. | 473/446 |
| 5,857,928 | A | * | 1/1999 | Stewart | 473/446 |
| D413,949 | S | * | 9/1999 | Oudemool et al. | D21/705 |
| 6,209,878 | B1 | * | 4/2001 | Munro | 273/400 |
| 6,264,572 | B1 | * | 7/2001 | Matheson et al. | 473/446 |
| 6,348,028 | B1 | * | 2/2002 | Cragg | 482/148 |
| 6,652,395 | B2 | * | 11/2003 | Goldwitz | 473/478 |
| 6,672,980 | B1 | * | 1/2004 | Walsh | 473/478 |
| 2002/0151387 | A1 | * | 10/2002 | Henson | 473/446 |

FOREIGN PATENT DOCUMENTS

| | | |
|---|---|---|
| GB | 188 | 1/1853 |

* cited by examiner

*Primary Examiner*—Mitra Aryanpour
(74) *Attorney, Agent, or Firm*—Hugh D. Jaeger

(57) ABSTRACT

A soccer training system which has three modes and includes a frame, a net, a target panel, and a rebound panel. The frame with the net secured thereto provides a soccer goal mode; the frame with the target panel positioned across its front provides a soccer target mode; and the frame with the rebound panel positioned across its front provides a soccer rebounder mode. The target panel has cutouts and/or apertures to pass a soccer ball. The rebound panel redirects a kicked ball back toward the kicker. The rebound panel can also be inclined to alter the return angle of the ball. Preferably, elastic corded hooks attach the target panel or the rebound panel to the front of the frame.

5 Claims, 13 Drawing Sheets

SOCCER TRAINING SYSTEM

CROSS REFERENCES TO RELATED APPLICATIONS

None.

BACKGROUND OF THE INVENTION

1. Field of the Invention

The present invention pertains to a soccer training system.

2. Description of the Prior Art

Soccer is a game played worldwide. Scoring occurs when a ball is kicked by an offensive player past an opposing defensive player, known as a goalie, attempting to prevent entry of the ball into a goal. When the offensive player is unsuccessful, the defensive player often has merely obstructed or deflected the inbound ball away from the face of the goal, thereby returning the ball to play. Typically, the defensive player's attempt to prevent the offensive player from scoring a goal is effective. The defensive player's occasional failures to prevent passage of the ball might be considered as allowing holes in goal coverage. These holes in goal coverage can be targeted and thereby exploited by experienced offensive players.

The aspiring offensive soccer player can benefit from practicing and training in front of a goal that is defended by a goalie. Such practicing and training promote more frequent success in scoring goals by improving the offensive player's effectiveness in kicking the soccer ball past the goalie and into the goal by recognizing and exploiting holes in the goalie's defense of the goal. Unfortunately, training time in front of a goal with a goalie is often limited. Moreover, for some novice players, practice with a live goalie may initially represent too great a challenge to be beneficial. However, both novice players and more experienced players can benefit from practicing and training with a static defensive simulation incorporating reproducible and repeatable defensive targets or returned kicks.

The present invention can provide a variety of useful soccer training exercises by allowing both novice and experienced offensive soccer players to practice with a simulated defended goal by kicking balls at target holes in the simulated defended goal or by contending with deflected kicks in the form of soccer balls rebounded from the simulated defended goal. Of course, a higher level of training would involve practice time in front of a soccer goal defended by a live goalie. The present invention allows practice approaching that level when a live goalie is unavailable. Moreover, without a live goalie defending the goal, novice offensive players can practice kicking soccer balls at an undefended goal. Further, the goal of the soccer training system of the present invention may also be used as a goal in an actual game of soccer. Still further, a goalie can also benefit from the present invention by practicing defending the goal from one or more offensive players. Clearly, there is a need for a soccer training system that can provide a multitude of training modes and options.

SUMMARY OF THE INVENTION

The general purpose of the present invention is to provide a training system for training soccer players.

According to the present invention, there is provided a training system for training soccer players, which consists of three modes: namely, a soccer goal mode involving a frame with an open net, a soccer target mode involving the frame with a target panel, and a soccer rebounder mode involving the frame with a rebound panel. In both the soccer rebounder mode and the soccer target mode, the net can be on the frame along with either the rebound panel or the target panel, or the net can be absent from the frame.

The soccer training system allows progressive training of an offensive soccer player. In one phase of progressive soccer training, the offensive training player can be provided with a simulation of a defended soccer goal which has only partial coverage of the face of the goal resulting from a target panel with clearly identifiable holes placed over the face of the goal. The holes act as targets to target with a kicked soccer ball. Each hole may be one of a plurality of apertures, cutouts, or other openings in a target panel obstructing the face of the goal. The holes acting as targets remain static while the player is allowed repeated opportunities to kick a ball through a hole. If successful, the ball passes through the hole in the target panel and into the goal. In another phase of progressive soccer training, the offensive training player may be provided with a simulation of a more effective opposing defense by fully covering the goal with a rebound panel. Again, the system can provide reproducible rebounds or returns of simulated unsuccessful kicks. The rebounded soccer ball allows a training offensive player to practice regaining control of the soccer ball after an unsuccessful kick attempt at the goal. Moreover, the return characteristics of a rebounded ball can be varied by altering the inclination of the rebound panel. Further, the soccer training system can be used as an open goal and, when augmented with a live goalie, the soccer training system provides a dynamic practice situation. Moreover, the open goal can be used without a goalie to train very young and/or inexperienced players the beginning skills to kick at an open or undefended goal. The system lends itself to a variety of orders of progressive training, and the orders of progressive training may be changed to match an identified training need. For example, one order of progressive training is to train initially with an undefended open goal, then train with a target panel over the face of the goal, then train with a rebound panel, (optionally, with different return angle characteristics in the rebounded soccer ball), then train with a live goalie, if available, or scrimmage in a practice game of soccer. Alternatively, another order of progressive training is to train initially with an undefended open goal, then train with a rebound panel (optionally altering the return angle of the rebounded ball), then train with a target panel, then train with a live goalie, if available, or scrimmage in a practice game of soccer. In either of these progressive training orders, the three modes of the soccer training system (goal, rebounder, and target) are employed at least once, although the order in which the modes are employed may be changed as appropriate.

One significant aspect and feature of the present invention is its multi-functional character.

Another significant aspect and feature of the present invention is the interchangeable nature of the present invention.

Yet another further significant aspect and feature of the present invention is the multiple apertures or cutouts of the target mode.

Still another additional significant aspect and feature of the present invention is its rebound training provision.

An additional significant aspect and feature of the present invention is that the nature of the rebound training provision can be varied in terms of the angle or incline of the return.

A still additional significant aspect and feature of the present invention is the static and reproducible training simulation provided by the target panel.

A further significant aspect and feature of the present invention is the reproducible training simulation of the rebound panel.

Having thus mentioned certain significant aspects and features of the present invention, it is the principal object of the present invention to provide a training system for training offensive soccer players.

One object of the present invention is to provide repeatable and reproducible simulations of a soccer goal in various conditions of defense.

Another object of the present invention is to provide a soccer goal that can be defended by a live goalie, when a live goalie is available.

Yet another object of the present invention is to enable interchangeability of goal training attachments for the soccer goal.

Still another object of the present invention is to provide a goal that may also be used in a regular soccer game.

A further object of the present invention is to provide a soccer training system that packs flat for transport or shipping and is subsequently easily assembled.

A still further object of the present invention is to provide a soccer training system that ships as a kit with assembly instructions.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
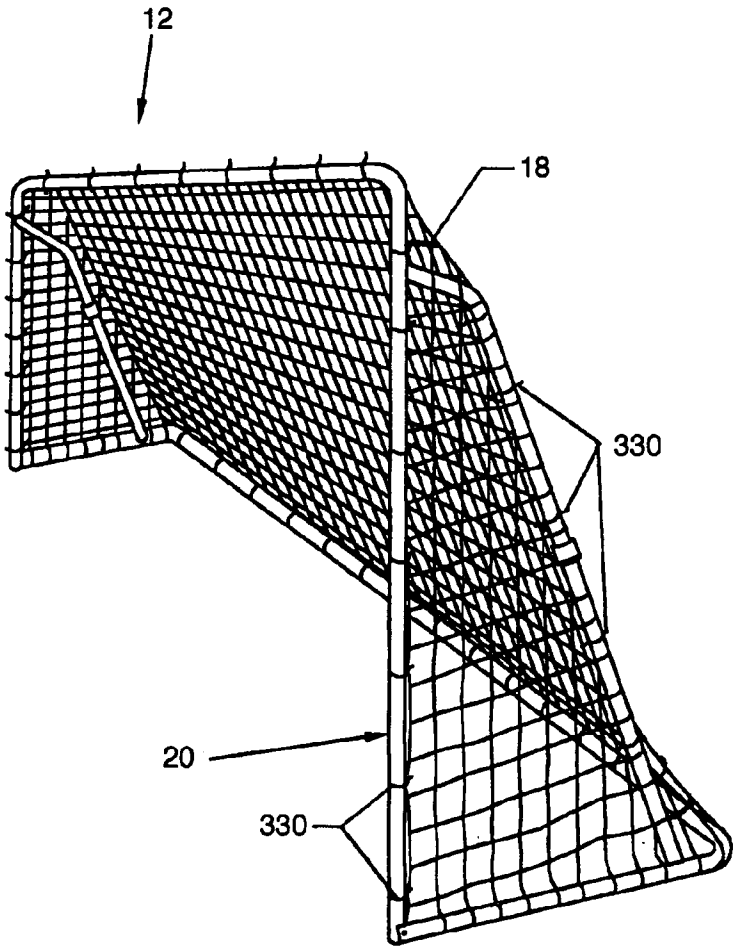
FIG. 1 illustrates a soccer goal, one mode of the soccer training system, the present invention.

FIG. 1 illustrates a soccer goal 12, one mode of the soccer training system, the present invention. The soccer goal 12 is one of three training modes, the other two being a soccer target 14, illustrated in FIG. 2, and a soccer rebounder 16, illustrated in FIG. 3. The soccer goal 12 includes a net 18 over a frame 20.

Figure 2:
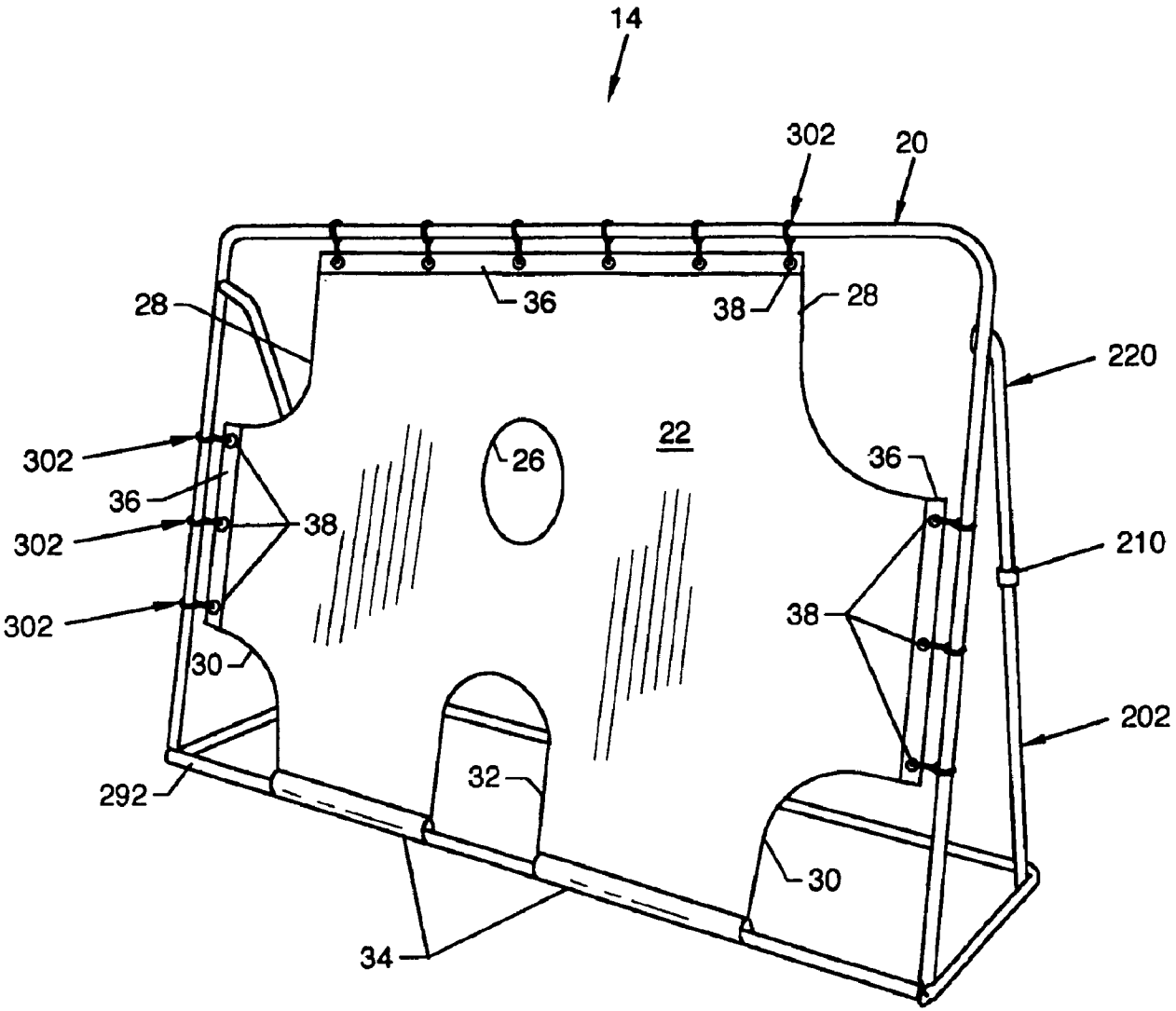
FIG. 2 illustrates a soccer target, a second mode of the soccer training system.

FIG. 2 illustrates the soccer target 14 mode of the soccer training system. The soccer target 14 includes frame 20 and a target panel 22. The target panel 22 includes at least one aperture 26, upper corner cutouts 28, lower corner cut-outs 30, and peripheral edge cutouts 32. The target panel 22 is attached to the frame 20. The target panel 22 has a sleeve 34 at the lower edge thereof for accepting a portion of the frame for slidethrough attachment to the frame 20. The target panel 22 has a turned and reinforced hem or lap-over 36 on its upper and side peripheries. Distributed along the lap-over 36 are a plurality of integral grommets 38 through which the target panel 22 is also attached to frame 20. Preferably, the target panel 22 is formed of plastic material, such as, for example, polyvinyl chloride or other similar materials which may be heat sealed or heat altered so as to form the lap-overs 36, the integral grommets 38 in the lap-overs 36, and the sleeve 34. The integral grommets 38 are heat formed within the lap-over 36. Additionally, reinforced edges are heat formed on the various cutouts 28, 30 and 32 and on aperture 26 to enhance durability of the target panel 14.

It should be clear that the positioning of the cutouts and/or apertures can be varied. However, it is important that each allows a soccer ball to pass, thereby providing a practice target for a training soccer player. The soccer target 14 provides a number of positions on which players may repeatedly focus their kicks of soccer balls. These focus points, corresponding to the cutouts and apertures, are static, which may be quite helpful to an intermediate level training offensive player. It should be understood that while the target panel 22 may be employed without the net 18, it is preferred to have the net 18 installed to catch any soccer ball passing the target panel 22.

Figure 3:
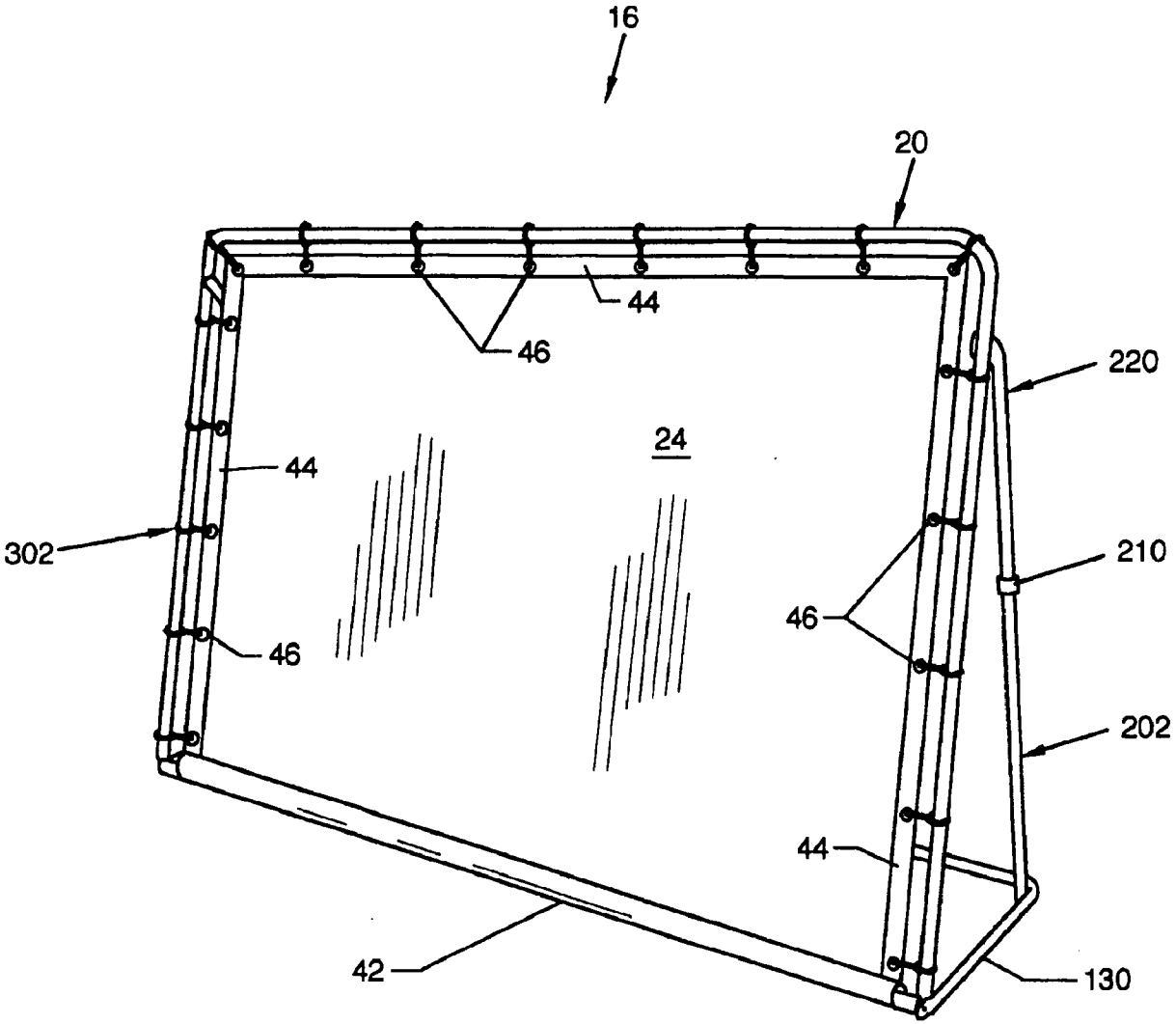
FIG. 3 illustrates a soccer rebounder, a third mode of the soccer training system.

FIG. 3 illustrates the soccer rebounder 16 mode of the soccer training system. The soccer rebounder 16 has a rebound panel 24 attached as an alternative to the target panel 22 of the soccer target 14. The rebound panel 24 is preferably a flexible nonstretch sheet or web. The rebound panel 24 has a lower sleeve 42 and a hem or lap-over 44 sewn at the upper and side peripheries. A plurality of grommets 46 are present in the lap-over 44. The grommets 46 serve to attach the rebound panel 24 to the frame 20. Preferably, the grommets 46 are brass grommets installed as two separate mating pieces which grasp and pinch together to the lap-over 44. Soccer balls kicked at the rebound panel 24 of the soccer rebounder 16 are reproducibly redirected by the rebound panel 24 such that they travel away from or out of the soccer rebounder 16 and generally back to the soccer field in front of the soccer rebounder 16. As will be explained subsequently, the angle of return can be adjusted by inclining the rebounder panel 24 while carried by the frame 20.

Figure 4:
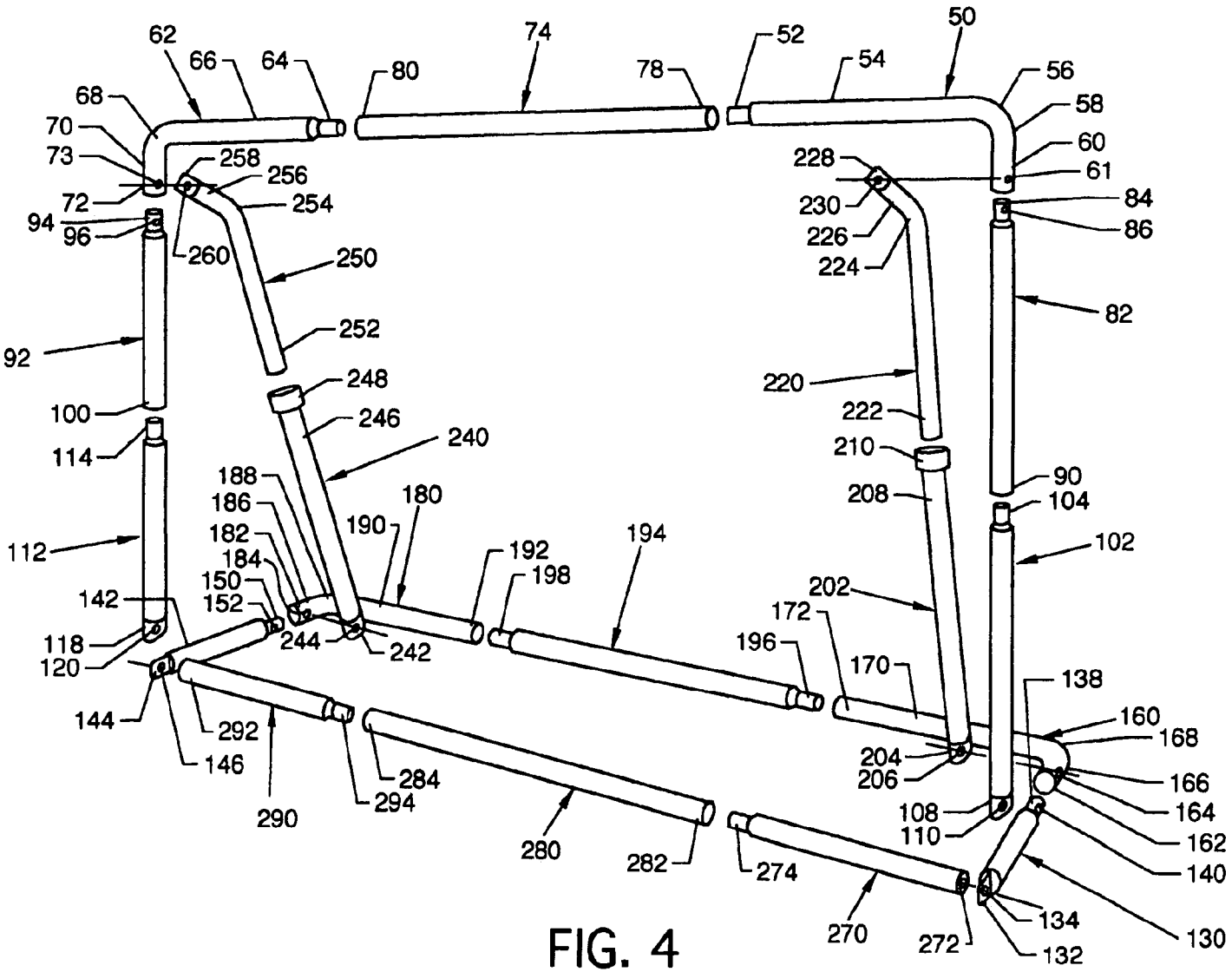
FIG. 4 illustrates an exploded view of a frame which is common to the soccer goal, the soccer target, and the soccer rebounder of the soccer training system.

FIG. 4 illustrates the frame 20 of the soccer training system in an exploded view to facilitate comprehension of the manner of assembly of the frame 20 and the versatility thereof. In describing the frame 20, the description herein adopts the point of reference of one standing before the frame 20 as it would be oriented toward a soccer field, such that the right of the frame 20 is on one's right, the left of the frame 20 is on one's left, and the rear of the frame 20 is more distant than the front of the frame 20. As described subsequently, the subparts of the frame 20 are connected in two basic manners: first, insertion of a reduced diameter end of one pole or tube into an unreduced connector end of another pole or tube; and second, bolted together, typically at a pivotable connection, through apertures at flattened ends of poles or tubes. Further, the frame 20 is generally bilaterally symmetrical with left and right sides being generally mirror images. With this orientation as to reference and manner of connection, the manner of assembly of the frame 20 is now set forth in detail.

The frame 20 includes a right L-shaped pole 50 having an insert end 52 on one end of a horizontal leg 54 and a curved corner 56 at the other end of the horizontal leg 54. The curved corner 56 leads to a short vertical leg 58 terminating in a connector end 60. A transverse aperture 61 traverses the connector end 60 and is oriented to accept a bolt directed parallel to the horizontal leg 54.

The frame 20 also includes a left L-shaped pole 62 having an insert end 64 on one end of a horizontal leg 66 and a curved corner 68 at the other end of the horizontal leg 66. The curved corner 68 leads to a short vertical leg 70 terminating in a connector end 72. A transverse aperture 73 transverses the connector end 72 and is oriented to accept a bolt directed parallel to the horizontal leg 66.

Centered in the upper span of the frame 20 and interposed between the right and left L-shaped poles 50 and 62, respectively, is a straight pole 74 having a right connector end 78 and a left connector end 80. When assembled, the right connector end 78 connectably receives the insert end 52 of the right L-shaped pole 50 and the left connector end 80 connectably receives the insert end 64 of the left L-shaped pole 62.

Connected below the connector end 60 of the right L-shaped pole 50 is an upper right straight pole 82 with an insert end 84 having a transverse aperture 86 therethrough, and a lower connector end 90. Similarly, connected below the connector end 72 of the left L-shaped pole 62 is an upper left straight pole 92 with an insert end 94 having a transverse aperture 96 therethrough, and a lower connector end 100.

Connected below the lower connector end 90 of the upper right straight pole 82 is a lower right straight pole 102 with an insert end 104, and a flattened end 108. Flattened end 108 is generally in contact with the ground supporting the frame 20 and has an aperture 110 therethrough oriented parallel to the upper center straight pole 74 to accept another bolt. Similarly, connected below the lower connector end 100 of the upper left straight pole 92 is a lower left straight pole 112 with an insert end 114, and a flattened end 118. Flattened end 118 is generally in contact with the ground supporting the frame 20 and has an aperture 120 therethrough oriented parallel to the upper center straight pole 74 to accept another bolt.

The frame 20 further includes a right straight ground pole 130 and a left straight ground pole 142. The right straight ground pole 130 has a flattened end 132 with an aperture 134 therethrough and an insert end 138 having a transverse aperture 140 therethrough, both apertures for accepting bolts. Aperture 110 of flattened end 108 aligns with aperture 134 of flattened end 132 to receive a bolt for forming a pivotable connection. Similarly, the left straight ground pole 142 has a flattened end 144 with an aperture 146 therethrough and an insert end 150 having a transverse aperture 152 therethrough, both apertures for accepting bolts. Aperture 120 of flattened end 118 aligns with aperture 146 of flattened end 144 to receive a bolt for forming a pivotable connection.

Connected to the insert end 138 of right straight ground pole 130 is a right L-shaped ground pole 160 which has a connector end 162 having a transverse aperture 164 therethrough. When insert end 138 is both inserted and aligned within connector end 162 and transverse aperture 164 is co-aligned with transverse aperture 140, a bolt is inserted through the apertures. The right L-shaped ground pole 160 has a short leg 166 which leads rearward to a curved corner 168 which in turn leads to a long leg 170 terminating at a connector end 172. Similarly, connected to the insert end 150 of left straight ground pole 142 is a left L-shaped ground pole 180 which has a connector end 182 having transverse aperture 184 therethrough. When insert end 150 is both inserted and aligned within connector end 182 and transverse aperture 184 is co-aligned with transverse aperture 152, a bolt is inserted through the apertures. The left L-shaped ground pole 180 has a short leg 186 which leads rearward to a curved corner 188 which in turn leads to a long leg 190 terminating at a connector end 192.

Centered on the ground at the rear of frame 20 and interposed between right L-shaped ground pole 160 and left L-shaped ground pole 180 is center straight ground pole 194. Center straight ground pole 194 has a right insert end 196 and a left insert end 198, each inserted to connect, respectively, in connector ends 172 and 192.

Together, right straight ground pole 130, right L-shaped ground pole 160, center straight ground pole 194, left L-shaped ground pole 180, and left straight ground pole 142 define and form a U-shaped ground support for frame 20. Together, lower right straight pole 102, upper right straight pole 82, right L-shaped pole 50, upper center straight pole 74, left L-shaped pole 62, upper left straight pole 92, and lower left straight pole 112 define and form a U-shaped front to the frame 20. This U-shaped front is pivotably connected to the U-shaped ground support, which U-shaped ground support is situated rearward of the U-shaped front.

Pivotably connected by a bolt to the right straight ground pole 130 and the right L-shaped ground pole 160 at co-aligned transverse apertures 140 and 164 at ground level on the right of frame 20 is a straight pole 202 having a flattened end 204 with an aperture 206 therethrough. Above flattened end 204 is a hollow tube 208 ending at a slide lock 210. Telescoped within slide lock 210 and hollow tube 208 is a support pole 220. Support pole 220 has a lower leg 222 telescoped within hollow tube 208 and lockable by slide lock 210 relative to hollow tube 208 of straight pole 202. At an upper end of lower leg 222 is an angled corner 224 leading in turn to an upper leg 226 which in turn ends at a flattened end 228 having an aperture 230 therethrough for a bolt. Aperture 230 of flattened end 228 is co-aligned with transverse apertures 61 and 86 on the U-shaped front of the frame 20 to accept a bolt to form a pivotable connection. Both flattened ends 204 and 228 are situated on the inward side of the U-shaped front and the U-shaped ground support for pivotable bolted connections thereto. The lockable telescoping relationship of the support pole 220 within straight pole 202 controls the inclination of the U-shaped front of the frame 20 relative to the U-shaped ground support by altering the angle at the two pivot points between, the U-shaped front and the U-shaped ground support.

Similarly on the left side of the frame 20, pivotably connected by a bolt to the left straight ground pole 142 and the left L-shaped ground pole 180 at co-aligned transverse apertures 152 and 184 at ground level on the left of frame 20 is a straight pole 240 having a flattened end 242 with an aperture 244 therethrough. Above flattened end 242 is a hollow tube 246 ending at a slide lock 248. Telescoped within slide lock 248 and hollow tube 246 is a support pole 250. Support pole 250 has a lower leg 252 telescoped within hollow tube 246 and lockable by slide lock 248 relative to hollow tube 246 of straight pole 240. At an upper end of lower leg 252 is an angled corner 254 leading in turn to an upper leg 256 which in turn ends at a flattened end 258 having an aperture 260 therethrough for a bolt. Aperture 260 of flattened end 258 is co-aligned with transverse apertures 73 and 96 on the U-shaped front of the frame 20 to accept a bolt to form a pivotable connection. Both flattened ends 242 and 258 are situated on the inward side of the U-shaped front and U-shaped ground support for pivotable bolted connections thereto. The lockable telescoping relationship of the support pole 250 within straight pole 240 controls the inclination of the U-shaped front of the frame 20 relative to the U-shaped ground support by altering the angle at the two pivot points between the U-shaped front and the U-shaped ground support.

It should be recognized that to avoid straining the frame 20, the right side, as represented by the telescoping relationship between the straight pole 202 and the support pole 220, and the left side, as represented by the telescoping relationship between the straight pole 240 and the support pole 250, should generate approximately the same angular relationship between the U-shaped front and the U-shaped ground support.

A detachable front ground bar is formed from right front ground pole 270, left front ground pole 290 and center front ground pole 280, interposed therebetween. In particular, right front ground pole 270 has a right corner bolt receiver end 272 connectable to and detachable from the lower right corner of frame 20 (i.e., flattened ends 108 and 132 with apertures 110 and 134, respectively), and a right front insert end 274 at the opposite end. Similarly, left front ground pole 290 has a left corner bolt receiver end 292 connectable to and detachable from the lower left corner of frame 20 (i.e., flattened ends 118 and 144 with apertures 120 and 146, respectively), and a left front insert end 294 at the opposite end. Right front insert end 274 is inserted into right connector end 282 of center front ground pole 280, and left front insert end 294 is inserted into left connector end 284 of center front ground pole 280, thereby forming the detachable front ground bar. Note that the center front ground pole 280 and the upper center straight pole 74 are preferably identical and interchangeable during assembly. The detachable front ground bar is threaded through the sleeves 34 and 42 of the target panel 22 and rebound panel 24, respectively.

Preferably, in a frame 20 having dimensions of about 84" wide by 60" tall by 30" deep, the right and left L-shaped poles 50 and 62, respectively, are mirror images and about 30.5" long.

Figure 5:
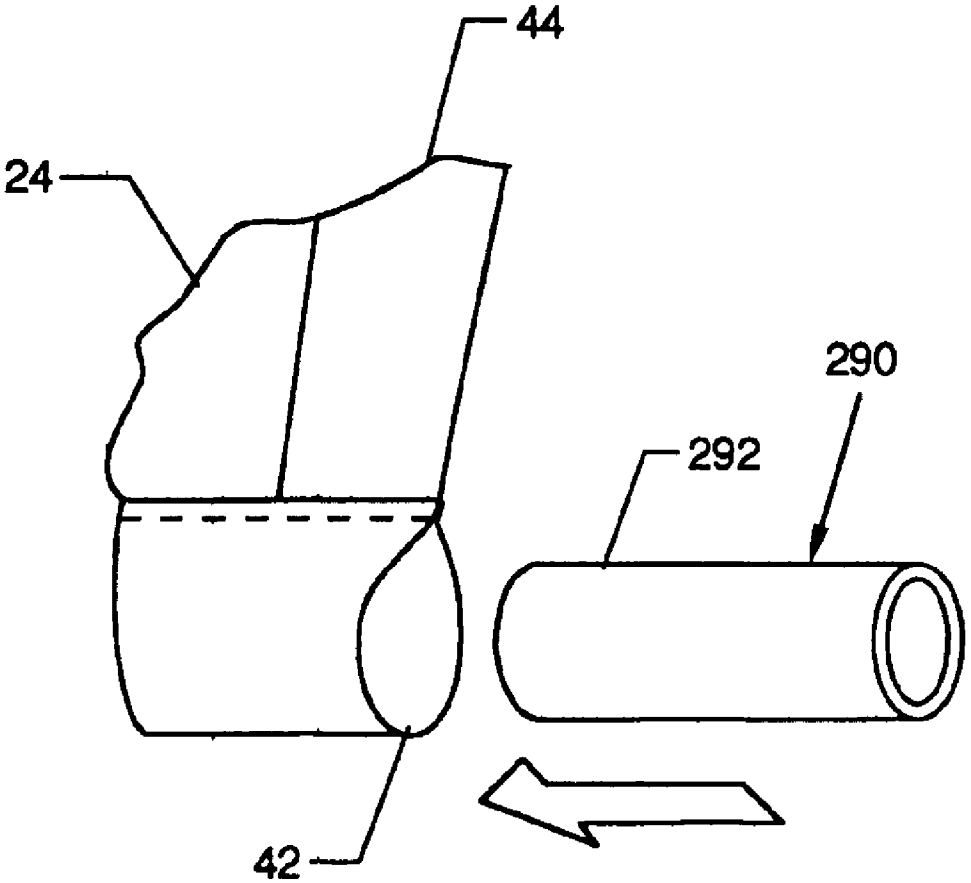
FIG. 5 illustrates a fragmentary view of the rebound panel being threaded onto a pole of the frame of the soccer training system.

FIG. 5 illustrates the right lower corner of the rebound panel 24 showing sleeve 42 receiving the left corner bolt receiver end 292 of the detachable front ground bar. The detachable front ground bar can be threaded in a like fashion into the sleeve 34 of the target panel 22 by initially inserting the left corner bolt receiver end 292 and continuing to thread the bar. Both the target panel 22 and the rebound panel 24 preferably are used with the detachable front ground bar to keep the sleeves of the panels down to the ground.

Figure 6:
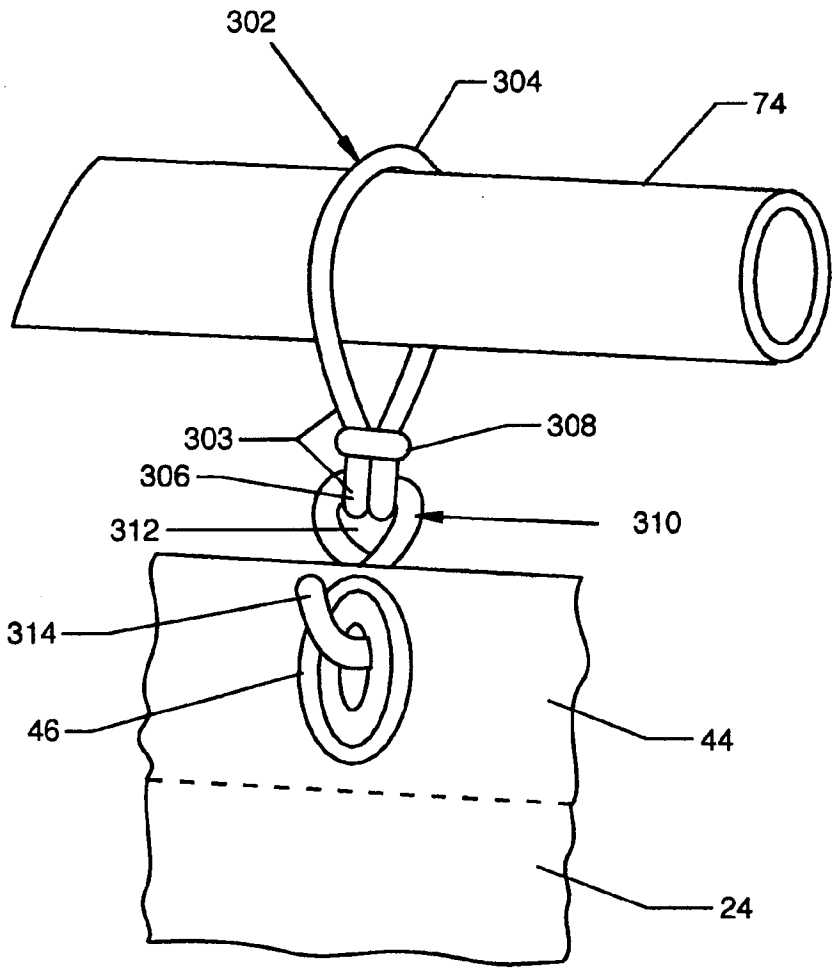
FIG. 6 illustrates a fragmentary view of a grommet of a rebound panel attached to a portion of the frame of the soccer training system.

FIG. 6 illustrates the upper portion of the frame 20, for example, the upper center straight pole 74, with a hook 302 attaching a grommet 46 of the rebound panel 24 thereto. Although this figure illustrates specifically the rebound panel 24, the same attaching means applied to the target panel 22. The hook 302 encircling or threaded upon the pole 74. The elastic cord 303 also forms a small loop 306 and is locked by a ring 308. An eye-hook 310 has a small eye 312 captured in the small loop 306. A larger hook end 314 of the eye-hook 310 is used to catch and hold the grommet 46. Several hooks 302 serve to resiliently hold the rebound panel on the U-shaped front of the frame 20. As earlier mentioned, the detachable front ground bar inserted into the rebound panel sleeve 42 on the bottom of the rebound panel 24 holds the rebound panel 24 against the ground and counters the hooks 302 at the top of the rebound panel 24. When the frame 20 is being assembled, hooks 302 should be threaded upon the U-shaped front of the frame 20 prior to installing an tying the net 18 on the frame 20. Preferably, the rebound panel 24 has about eight grommets 46 on the upper lap-over 44 and about five or six on each side lap-over 44, whereas the target panel 22 preferably has only about six upper integral grommets 38 on the upper lap-over 36 and only about three integral grommets 38 on each side lap-over 36. Therefore, preferably, at least one hook 302 should be provided for each grommet 46 of the rebound panel 24, and sufficient hooks 302 will be available whenever the target panel 22 is substituted for the rebound panel 24. In a kit of the present invention, preferably about eighteen or twenty hooks 302 are included.

Figure 7:
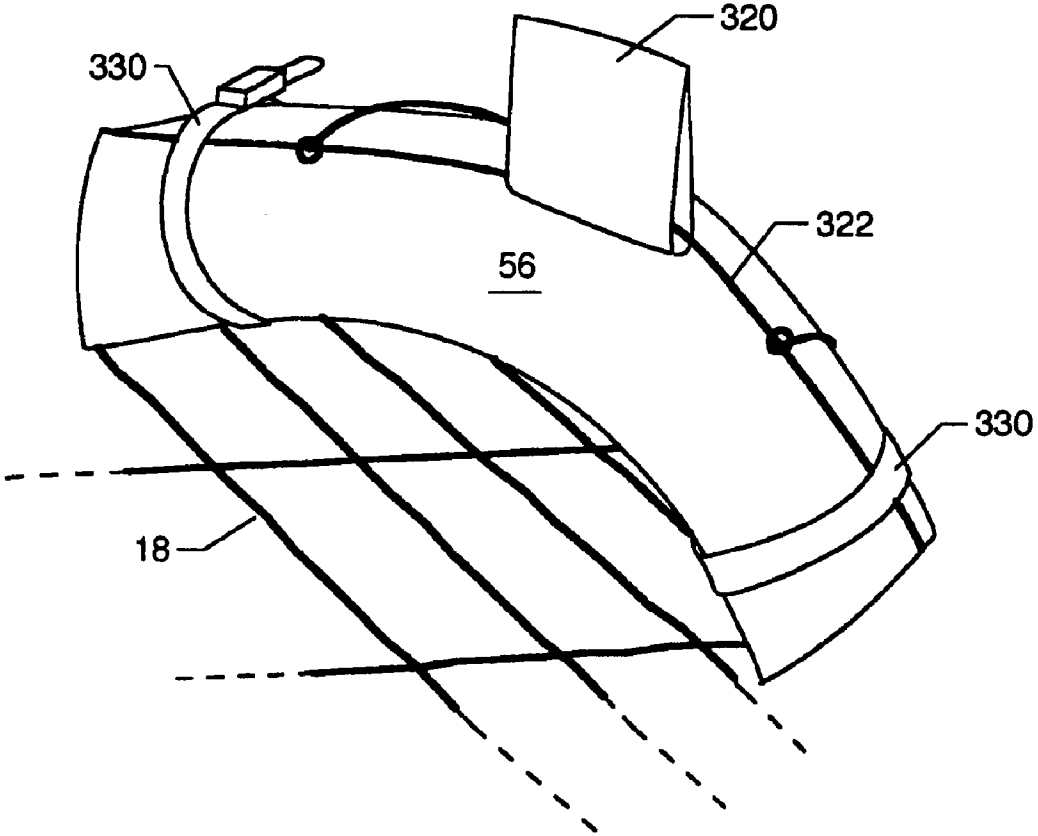
FIG. 7 illustrates a fragmentary view of a net corner and a corner tab attached to a portion of the frame of the soccer training system.

FIG. 7 illustrates the upper right corner of the frame 20 with the net 18, showing a corner tab 320. Preferably, the corner tabs 320 have a visually distinct appearance relative to the net 18, and most preferably, a visually distinct color such as red. Preferably, only two corner tabs 320 are present on the net 18. Each corner tab 320 is sewn into seam 322 of net 18 and facilitates appropriate orientation during installation of the net 18. In a kit of the present invention, assembly instructions include a discussion of how the corner tabs 320 should be arranged relative to the frame 20. Once the net 18 is appropriately arranged relative to the frame 20 (i.e., with the corner tabs 320 situated at upper curved corners 56 and 68), the seam 322 of net 18 is attached to the frame with net ties 330. Net ties 330 encircle both the pole and the net seam 322. The installed net 18 is shown in FIG. 1 and includes an open front, closed right and left sides and a back draped over the frame 20 so as to catch a soccer ball entering the soccer goal 12.

Figure 8:
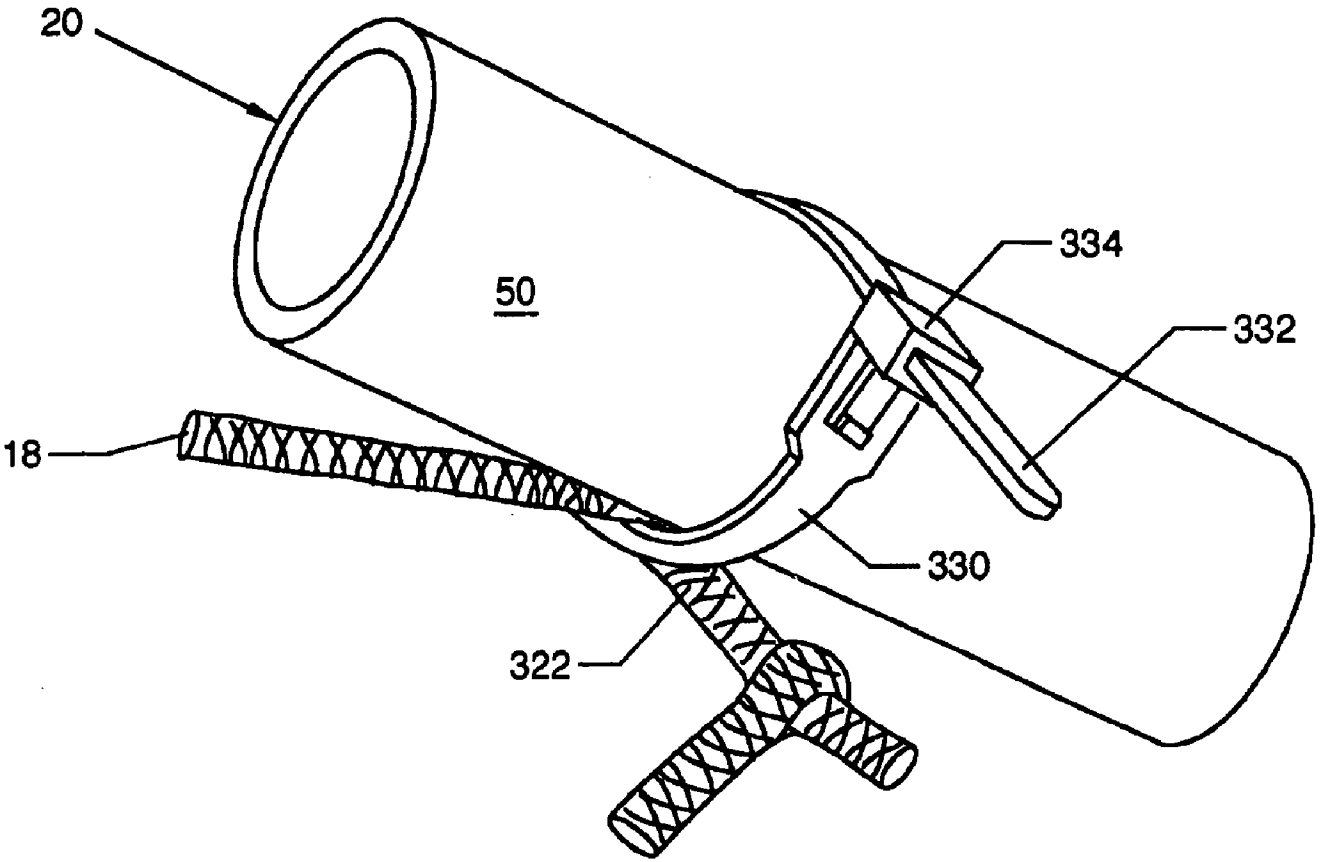
FIG. 8 illustrates a detail view of a portion of a net attached to a portion of the frame of the soccer training system.

FIG. 8 illustrates a detail of the net ties 330 on the seam 322 of net 18. Each net tie 330 includes a flexible ratchet shaft 332 and a ratchet head 334 which traps the flexible ratchet shaft 332 threaded therethrough. The trapping of the shaft 332 in the ratchet head 334 forms a loop encircling the seam 322 and the pole 50. The net ties 330, preferably about 36 net ties 330, are preferably included in a kit of the present invention and during assembly are distributed relatively evenly along the U-shaped front and U-shaped ground support, as well as along the telescopic support poles 220 and 250 and the straight poles 202 and 240, thereby binding seams 322 of the net 18 to the frame 20. Preferably, the kit of the present invention includes instructions concerning distribution and employment of the net ties 330 to attach the net 18 to the frame 20.

Figure 9:
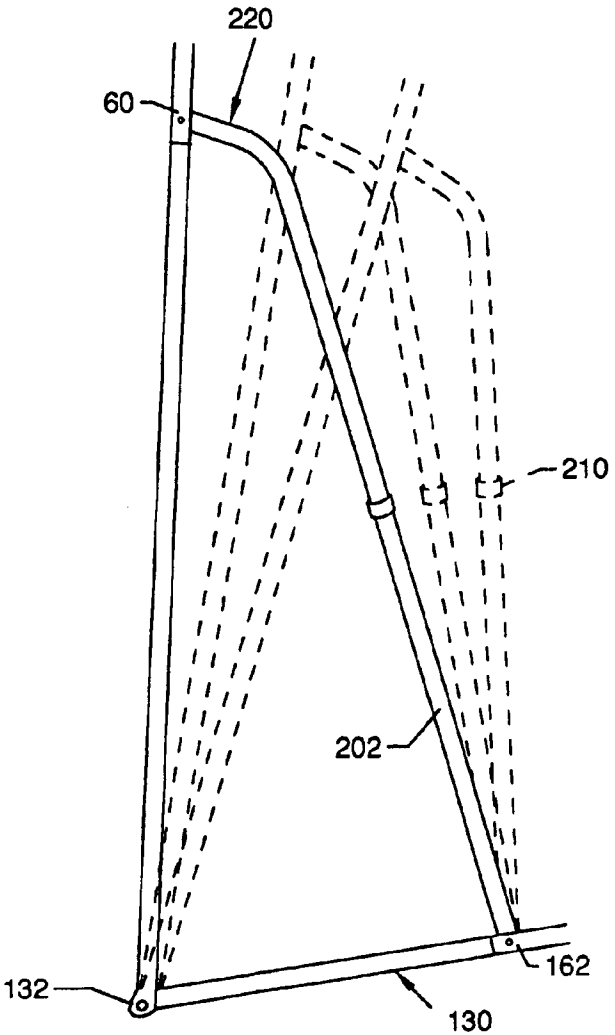
FIG. 9 illustrates a side view of the frame of the rebounder mode of the soccer training system in an inclined position, with alternative inclined positions indicated in ghost-dashed outline.

FIG. 9 illustrates inclination and adjustment of the U-shaped front by the right telescopic support pole 220 and the slide lock 210 of right straight pole 202. As the support pole 220 is reduced in exposure, the U-shaped front inclines.

Progressive inclination is shown in ghost outline. As shown in further detail in FIGS. 10A and 10B, the telescope mechanism also includes a spring button 340 carried by a portion of the support pole 220 within the straight pole 202. Receiver presets or apertures 342 along the straight pole 202 catch or capture the spring button 340, thereby providing a second lock system for the telescopic arrangement controlling inclination. The spring button 340 and receiver presets or apertures 342 are preferably described in instructions included in a kit of the present invention. The structure on the left of the frame 20 is a mirror image and should be set to roughly the same inclination to avoid straining the frame 20.

Figure 10A:
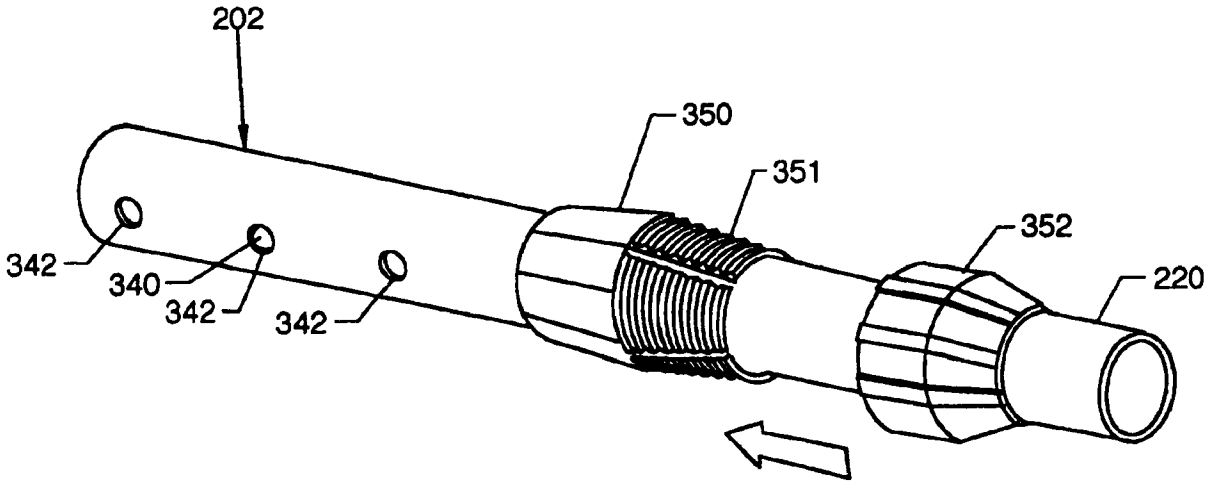
FIG. 10A and FIG. 10B illustrate fragmentary views of the assembly and operation of the slide lock of the frame of the soccer training system.
Figure 10B:
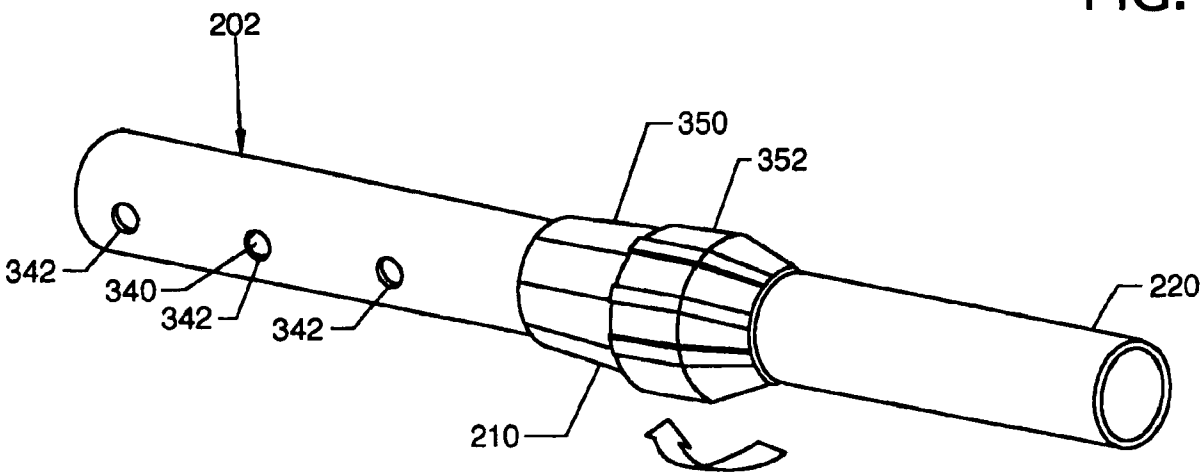

FIGS. 10A and 10B illustrate details of the telescopic slide lock 210. As shown in FIG. 10A, the slide lock 210 includes an internal hub 350, joined to straight pole 202, with a plurality of threaded fingers 351 and a separable threaded collar 352 which, when tightened as shown in FIG. 10B, forces the threaded fingers 351 to compress and grasp the support pole 220 telescoped therethrough. The telescope mechanism also includes a spring button 340 carried by a portion of the support pole 220 within the straight pole 202. A plurality of receiver presets or apertures 342 are distributed along the straight pole 202 and serve to catch or capture the spring button 340, thereby providing a second lock system for the telescopic arrangement controlling inclination. The spring button 340 and receiver presets or apertures 342 are preferably described in instructions included in a kit of the present invention. Most preferably the two telescopic lock systems are used together to more reliably stabilize a selected inclination. When substantially no inclination is selected, soccer balls striking the rebound panel 24 of the soccer rebounder 16 mode of the present invention will be returned to play at an angle generally parallel to the ground. As the inclination is increased, for example, by selecting a receiver preset or aperture 342, from among the plurality of receiver presets or apertures 342, which is lower on the straight pole 202, soccer balls returned from the rebound panel 24 will have a steeper return angle relative to the ground, providing a practicing player with a more challenging practice. The structure on the left of the frame 20 is a mirror image and should be set to roughly the same inclination to avoid straining the frame 20. The preferred instructions of the kit of the present invention include instructions to use the same inclination on both the right and left sides of the frame 20.

Figure 11:
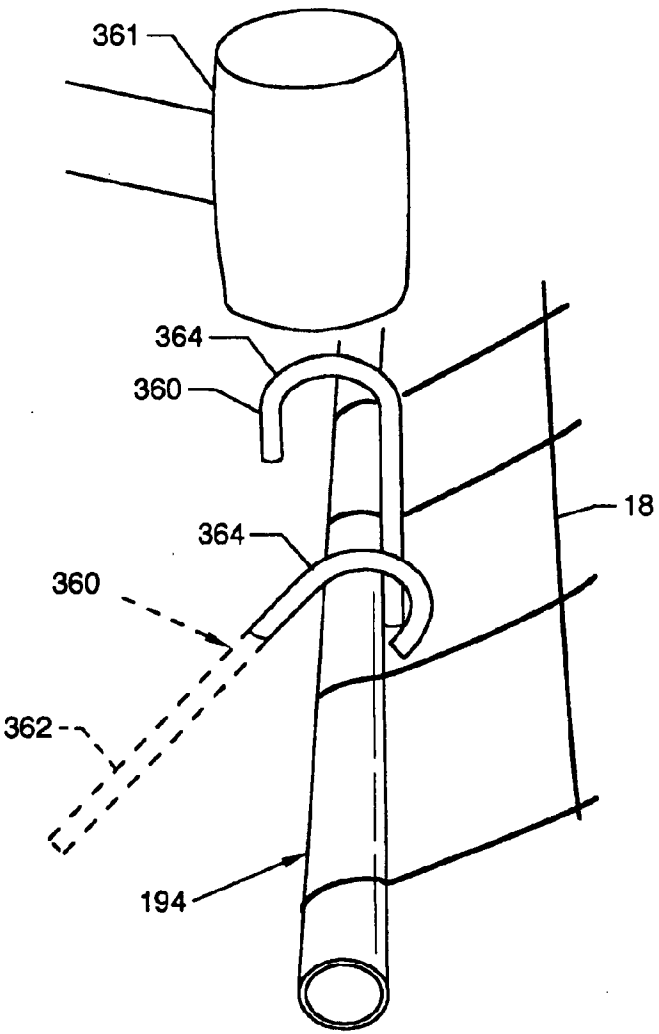
FIG. 11 illustrates a fragmentary view of a portion of the frame of the soccer training system being attached to the ground.

FIG. 11 illustrates a portion (center straight ground pole 194) of the frame 20 being attached to the ground with stakes 360 (sometimes also referred to as frame pegs). Preferably, the stakes 360 are pounded into the ground with a mallet 361. Each stake 360 includes a stake shaft 362 and a stake hook 364. The stake hook 364 is arranged to capture a portion of the frame 20 in contact with the ground along with a portion of the net 18 attached thereto. Preferably, the stakes 360 are used in pairs, as further shown in FIG. 12.

Figure 12:
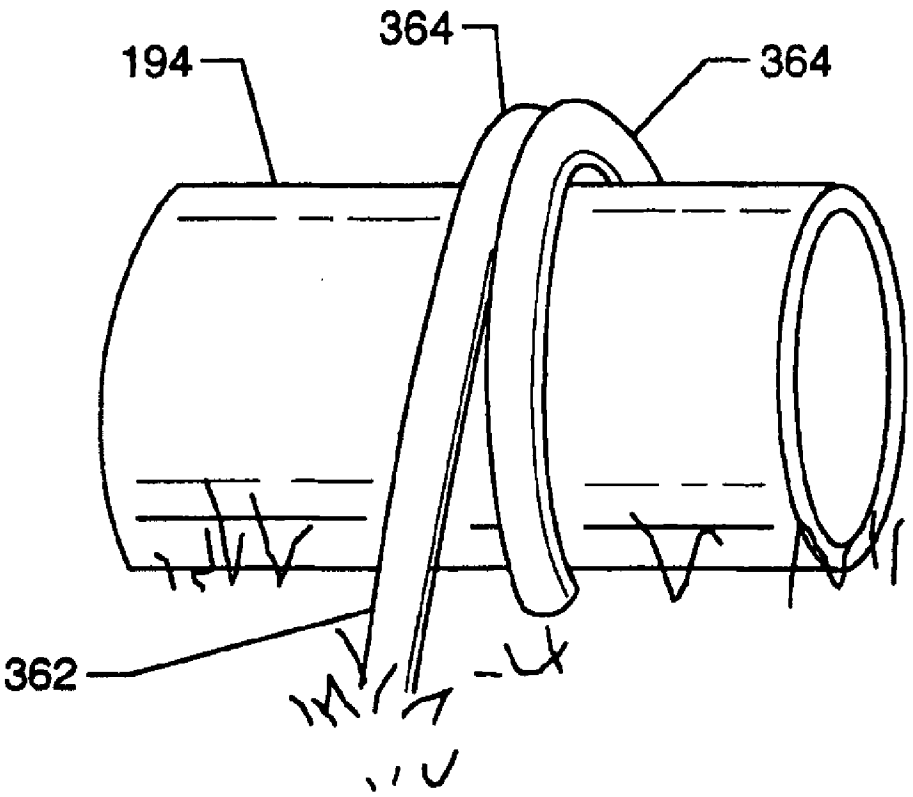
FIG. 12 illustrates a fragmentary view of a portion of the frame of the soccer training system attached to the ground; and, FIG. 13 illustrates preferred positioned of ground attachment points for the frame of the soccer training system.

FIG. 12 illustrates in detail the stakes 360 being doubled to better reinforce the attachment of the frame 20 to the ground. Preferably, the stakes 360 are used in pairs such that one shaft 362 of the pair of stakes passes on one side of the pole 194 and the other shaft 362 passes on the other side of the pole 194. In this opposed arrangement of stakes 360, the frame 20 is more firmly anchored to the ground. Preferably, instructions included in the kit of the present invention explain the opposed paired capturing of the frame 20 by stakes 360 included in the kit. Preferably, the kit includes about eight stakes 360.

Figure 13:
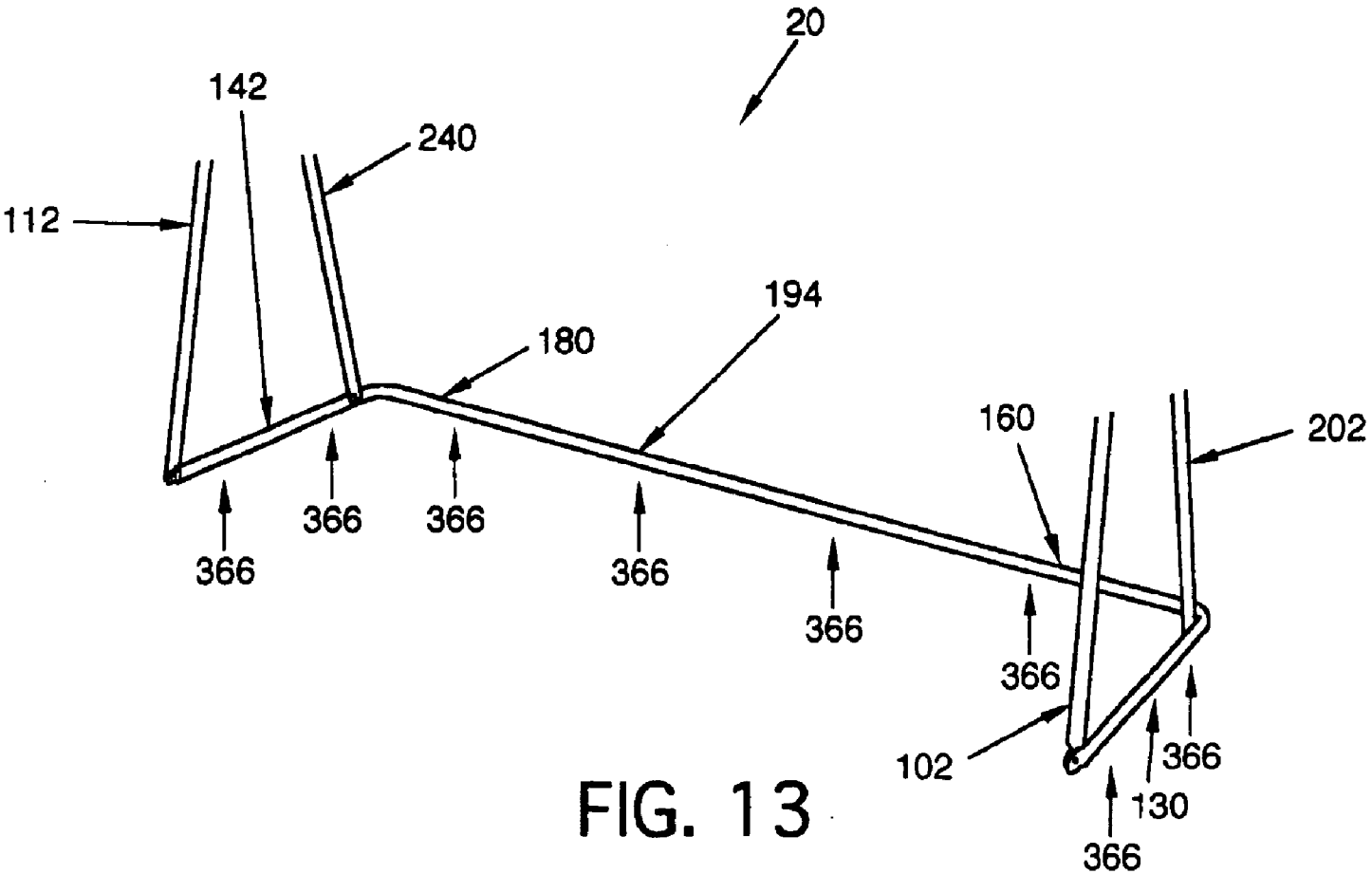

FIG. 13 illustrates preferred positions 366 for staking, preferably double staking, the frame 20 to the ground. The preferred staking positions 366 preferably are alternated in whether the stake 360 has the associated stake shaft 362 inside or outside of the U-shaped frame structure portion in contact with the ground. This alternation of staking can achieve the preferred opposed arrangement of double staking on the left side upon left straight ground pole 142, and on the right side upon right straight ground pole 130. Along the back, preferably two pairs of opposed stakes 360 anchor along right L-shaped ground pole 160, interposed center straight ground pole 194 and left L-shaped ground pole 180. Instructions within the kit preferably advise an assembler of such locations as well as the alternating opposition of stake shafts 362 in each pair.

MODE OF OPERATION

The soccer training system is used as a three-in-one trainer. With the three-in-one trainer an offensive player may select to use the system to train with any one of the target panel 22 (thereby selecting the soccer target 14 mode); the rebound panel 24 (thereby selecting the soccer rebounder 16 mode); or only the frame 20 with the net 18 (thereby selecting the open soccer goal 12 mode). Preferably, the training can be progressive. For example, first using an open goal to learn the general kick toward a goal, then a target panel 22 to practice precise kicks to a static aperture or cutout representing an undefended portion of the goal, then next exchange the target panel 22 for a rebound panel 24, and finally, if a goalie is available, practice with a live goalie. Moreover, the soccer training system may be used as a regular soccer goal 12 in a game (assuming it is of league approved size for the soccer game). It should be recognized that the goalie as well as the offensive player might be receiving practice and training in the open soccer goal 12 mode when under offensive attack by one or more offensive players. It should be noted that the target panel 22 and the rebound panel 24 are alternatively selectively secured to the frame 20 by hooks 302. Preferably, this securing is accomplished under adult supervision, as considerable tension is present in the panels when so secured. Additionally, it should be noted that changing to one of the two modes utilizing a panel also involves threading a ground bar through the sleeve at the base of the panel. This ground bar is then attached at the pivotable lower corners. Specifically, with the ground bar threaded through the sleeve of the selected panel, the right corner bolt receiver end 272 is bolted to flattened end 108 and flattened end 132 at the right pivotable corner. (In the absence of a panel and the ground bar, a wing nut is employed to maintain the pivotable connection on the bolt.) Similarly, with the ground bar threaded through the sleeve of the selected panel, the left corner bolt receiver end 292 is bolted to flattened end 118 and flattened end 144 at the left pivotable corner. (In the absence of a panel and the ground bar, a wing nut is employed to maintain the pivotable connection on the bolt.)

When the rebound panel 24 is installed to select the soccer rebounder 16 mode, the inclination of the rebound panel 24 by use of the telescopic inclination control is also significant, in that the return pattern of the soccer ball may also be adjusted and varied to further enhance the practice afforded to a practicing player. The soccer rebounder 16 mode is especially useful for a user desiring to practice his or her defensive skills. The soccer rebounder 16 mode can be used by a goal keeper in the following fashion, but not limited to practice distribution involving throwing or rolling where the goal keeper can roll or throw the ball at the soccer rebounder 16 to practice accuracy in distribution techniques. The soccer rebounder 16 prevents the ball from rolling a far distance after distribution assuming that the goal keeper hits the soccer rebounder 16. Upon a successful distribution, the ball conveniently returns to the goal keeper, saving time, and thus provides the goal keeper the ability to practice alone when he or she does not have a partner.

Use of the soccer rebounder 16 also allows the goal keeper to practice agility against quick rebounds and shots. The goal keeper can roll, throw or kick the ball at the soccer rebounder 16. After the ball hits the soccer rebounder 16, it will return to the goal keeper simulating a shot on the goal. The goal keeper can practice his or her keeping technique in this fashion and the goal keeper is provided the ability to practice alone when he or she does not have a partner.

The soccer rebounder 16 can be used by a field player in the following fashion, but not restricted to practicing his or her "throw in" technique by throwing the ball at the soccer rebounder 16. After the ball his the soccer rebounder 16, the ball conveniently returns to the player, saving time, and thus provides the field player the ability to practice alone when he or she does not have a partner.

The field player can practice ball control techniques by serving the ball at the soccer rebounder 16 and controlling the ball using various surfaces of his or her body, such as the head, thighs, feet, chest or other such surfaces, to control the ball after the ball returns off the soccer rebounder 16. As before, this provides the field player the ability to practice alone when he or she does not have a partner.

Safety is also an aspect of the present invention. The curved corners 56 and 68 of the frame 20 tend to reduce the likelihood of injuries that could be inadvertently caused by sharp corners. Similarly, the curved corners 224 and 254 characterize the right and left support poles 220 and 250. Additionally and preferably, the frame 20 is preferably shipped disassembled for more economical shipment. Instructions included in the preferred kit facilitate assembly of the frame 20 as well as installation of the net 18 and hooks 302.

SOCCER TRAINING SYSTEM PARTS LIST

| | |
|---|---|
| 12 | soccer goal |
| 14 | soccer target |
| 16 | soccer rebounder |
| 18 | net |
| 20 | frame |
| 22 | target panel |
| 24 | rebound panel |
| 26 | aperture |
| 28 | upper corner cutout |
| 30 | lower corner cutout |
| 32 | peripheral edge cutout |
| 34 | target panel sleeve |
| 36 | lap-over |
| 38 | integral grommets |
| 42 | rebound panel sleeve |
| 44 | rebounder lap-over |
| 46 | grommets |
| 50 | right L-shaped pole |
| 52 | insert end |
| 54 | horizontal leg |
| 56 | curved corner |
| 58 | short vertical leg |
| 60 | connector end |
| 61 | transverse aperture |
| 62 | left L-shaped pole |
| 64 | insert end |
| 66 | horizontal leg |
| 68 | curved corner |
| 70 | short vertical leg |
| 72 | connector end |
| 73 | transverse aperture |
| 74 | upper center straight pole |
| 78 | right connector end |
| 80 | left connector end |
| 82 | upper right straight pole |

-continued

SOCCER TRAINING SYSTEM PARTS LIST

| | |
|---|---|
| 84 | insert end |
| 86 | transverse aperture |
| 90 | lower connector end |
| 92 | upper left straight pole |
| 94 | insert end |
| 96 | transverse aperture |
| 100 | lower connector end |
| 102 | lower right straight pole |
| 104 | insert end |
| 108 | flattened end |
| 110 | aperture |
| 112 | lower left straight pole |
| 114 | insert end |
| 118 | flattened end |
| 120 | aperture |
| 130 | right straight ground pole |
| 132 | flattened end |
| 134 | aperture |
| 138 | insert end |
| 140 | transverse aperture |
| 142 | left straight ground pole |
| 144 | flattened end |
| 146 | aperture |
| 150 | insert end |
| 152 | transverse aperture |
| 160 | right L-shaped ground pole |
| 162 | connector end |
| 164 | transverse aperture |
| 166 | short leg |
| 169 | curved corner |
| 170 | long leg |
| 172 | connector end |
| 180 | left L-shaped ground pole |
| 182 | connector end |
| 184 | transverse aperture |
| 186 | short leg |
| 188 | curved corner |
| 190 | long leg |
| 192 | connector end |
| 194 | center straight ground pole |
| 196 | right insert end |
| 198 | left insert end |
| 202 | straight pole |
| 204 | flattened end |
| 206 | aperture |
| 208 | hollow tube |
| 210 | slide lock |
| 220 | support pole |
| 222 | lower leg |
| 224 | angled corner |
| 226 | upper leg |

| | | | |
|---|---|---|---|
| 228 | flattened end | 302 | hook |
| 230 | aperture | 303 | elastic cord |
| 240 | straight pole | 304 | large loop |
| 242 | flattened end | 306 | small loop |
| 244 | aperture | 307 | small loop |
| 246 | hollow tube | 308 | ring |
| 248 | slide lock | 310 | eye-hook |
| 250 | support pole | 312 | eye |
| 252 | lower leg | 314 | hook end |
| 254 | angled corner | 320 | corner tab |
| 256 | upper leg | 322 | seam |

-continued

| | | | |
|---|---|---|---|
| 258 | flattened end | 330 | net tie |
| 260 | aperture | 332 | flexible ratchet shaft |
| 270 | right front ground pole | 334 | ratchet head |
| 272 | right corner bolt receiver end | 340 | spring button |
| | | 342 | receiver presets or apertures |
| 274 | right front insert end | 350 | internal hub |
| 280 | center front ground pole | 351 | threaded fingers |
| 282 | right connector end | 352 | threaded collar |
| 284 | left connector end | 360 | stakes |
| 290 | left front ground pole | 361 | mallet |
| 292 | left corner bolt receiver end | 362 | stake shaft |
| | | 364 | stake hook |
| 294 | left front insert end | 366 | staking positions |

Various modifications can be made to the present invention without departing invention without departing from the apparent scope hereof.

It is claimed:

1. A soccer training system which has three modes, the system comprising:

a. a frame with an open net providing a soccer goal mode;

b. a soccer target panel positionable upon the frame, the soccer target panel having a sleeve and a detachable front ground bar insertable within the sleeve and attachable to the frame, thereby providing a soccer target mode; and, c. a rebound panel, the rebound panel having a sleeve, the detachable ground bar being insertable within the sleeve and positionable across the frame providing a soccer rebounder mode, whereby in both the soccer rebounder mode and the soccer target mode, the net can remain on the frame along with either the rebound panel or the target panel.

2. The soccer training system of claim 1, wherein the frame further includes an adjustable incline means.

3. The soccer training system of claim 2, wherein the adjustable incline means includes telescopic support poles.

4. The soccer training system of claim 3, wherein each telescopic support pole includes a slide lock.

5. The soccer training system of claim 1, wherein the soccer target panel and the soccer rebound panel each may be attached to the frame with elastic corded hooks.

* * * * *